US008948626B2

(12) United States Patent
Ishii

(10) Patent No.: US 8,948,626 B2
(45) Date of Patent: Feb. 3, 2015

(54) CLEANING DEVICE AND ELECTROPHOTOGRAPHIC APPARATUS

(71) Applicant: Fuji Xerox Co., Ltd., Tokyo (JP)

(72) Inventor: Toru Ishii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 97 days.

(21) Appl. No.: 13/628,636

(22) Filed: Sep. 27, 2012

(65) Prior Publication Data

US 2013/0156448 A1 Jun. 20, 2013

(30) Foreign Application Priority Data

Dec. 16, 2011 (JP) ..... 2011-275202

(51) Int. Cl.
*G03G 21/00* (2006.01)

(52) U.S. Cl.
USPC ..... 399/34; 399/71; 399/353

(58) Field of Classification Search
USPC ..... 399/34, 71, 353, 343, 349; 15/256.5, 15/256.51, 256.52
See application file for complete search history.

(56) References Cited

U.S. PATENT DOCUMENTS

| | | | | |
|---|---|---|---|---|
| 5,229,817 | A * | 7/1993 | Lange et al. | 399/34 |
| 2005/0100374 | A1 | 5/2005 | Satoh et al. | |
| 2007/0292150 | A1* | 12/2007 | Lu et al. | 399/34 |
| 2009/0116862 | A1* | 5/2009 | Nishida et al. | 399/71 |
| 2010/0046998 | A1* | 2/2010 | Imaizumi | 399/353 |
| 2012/0033986 | A1* | 2/2012 | Nakaegawa | 399/71 |

FOREIGN PATENT DOCUMENTS

| | | |
|---|---|---|
| JP | A-2-251874 | 10/1990 |
| JP | A-2006-106017 | 4/2006 |
| JP | A-2010-217512 | 9/2010 |

* cited by examiner

*Primary Examiner* — Sophia S Chen
(74) *Attorney, Agent, or Firm* — Oliff PLC

(57) ABSTRACT

Provided is a cleaning device including a brush roll that removes residual toner remaining on a surface of a toner image carrier provided in an electrophotographic apparatus, and a pressure detector that contacts the surface of the brush roll with preload, and outputs a detected pressure value to a determination unit that is provided in the electrophotographic apparatus to determine the adhesion state of toner to the brush roll.

4 Claims, 11 Drawing Sheets

CLEANING DEVICE AND ELECTROPHOTOGRAPHIC APPARATUS

CROSS-REFERENCE TO RELATED APPLICATIONS

This application is based on and claims priority under 35 USC 119 from Japanese Patent Application No. 2011-275202 filed Dec. 16, 2011.

BACKGROUND (i) Technical Field

The present invention relates to a cleaning device that removes residual toner remaining on the surface of a toner image carrier provided in an electrophotographic apparatus, and an electrophotographic apparatus including the cleaning device.

(ii) Related Art

Electrophotographic apparatuses are, for example, apparatuses, such as a copying machine, a facsimile machine, a printer apparatus, and a composite machine having these functions together, which form an image by transferring a toner image carried on a carrier, such as a photoconductor drum, to a recording medium, such as paper.

Such an electrophotographic apparatus includes a cleaning device that removes the residual toner remaining on the surface of the toner image carrier, and the cleaning device cleans the surface of the carrier to which the toner image is transferred.

SUMMARY

According to an aspect of the invention, there is provided a cleaning device including a brush roll that removes residual toner remaining on a surface of a toner image carrier provided in an electrophotographic apparatus; and a pressure detector that contacts the surface of the brush roll with preload, and outputs a detected pressure value to a determination unit that is provided in the electrophotographic apparatus to determine the adhesion state of toner to the brush roll.

BRIEF DESCRIPTION OF THE DRAWINGS

Exemplary embodiments of the present invention will be described in detail based on the following figures, wherein.

DETAILED DESCRIPTION

First, an example of an electrophotographic apparatus that carries out the invention will be described.

Figure 10:
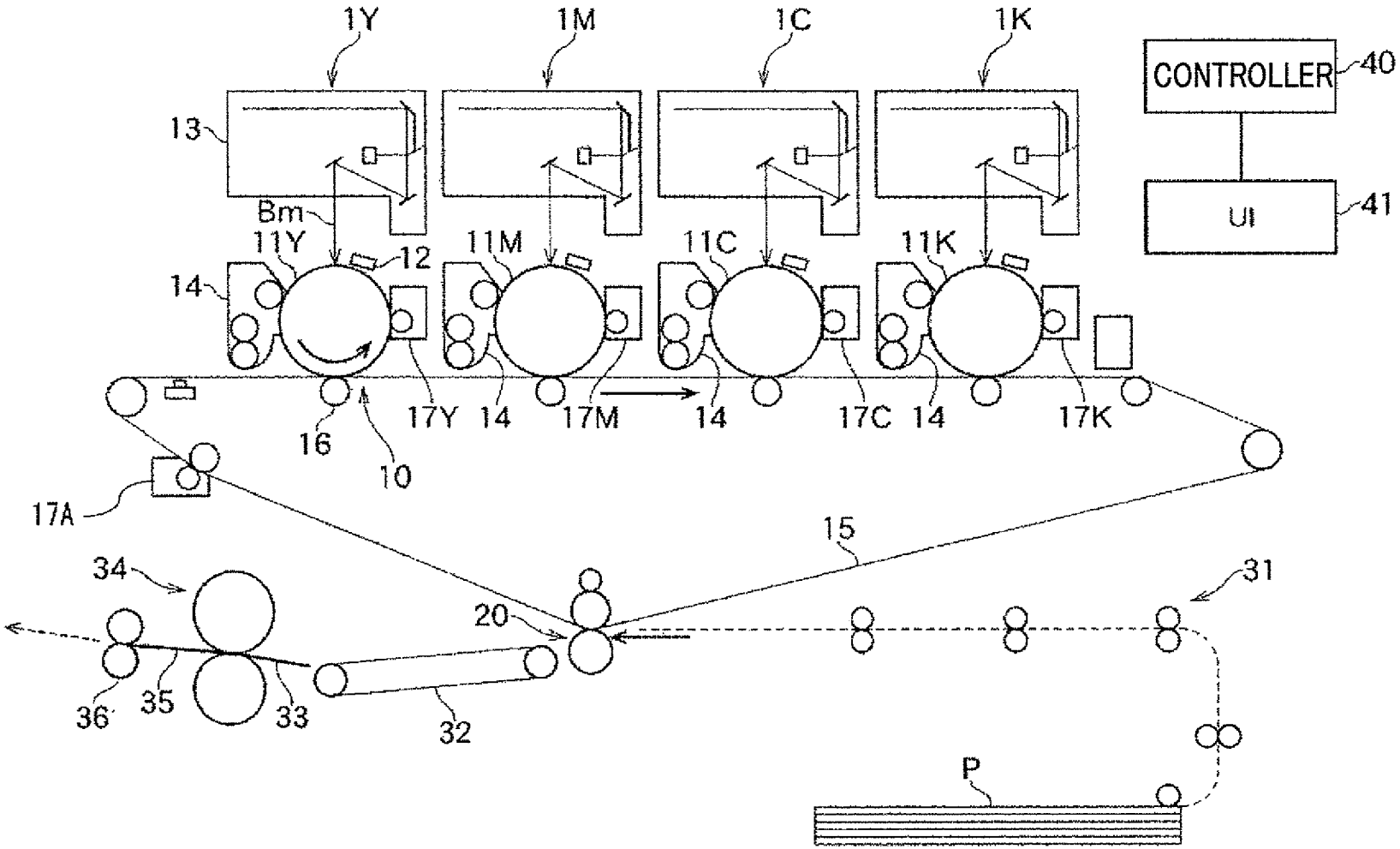
FIG. 10 is a view illustrating a configuration related to an example of the electrophotographic apparatus.

In FIG. 10, the structure of an image forming section in the electrophotographic apparatus of this example is illustrated.

The illustrated electrophotographic apparatus is generally an intermediate transfer type called a tandem type, and includes, as typical functional sections, plural image forming units 1Y, 1M, 1C, and 1K in which toner images of respective color components are formed using an electrophotographic method, a primary transfer section 10 that sequentially transfers (primarily transfers) the respective color component toner images formed by the respective image forming units 1Y, 1M, 1C, and 1K to an intermediate transfer belt 15, a secondary transfer section 20 that collectively transfers (secondarily transfers) a superposed toner image transferred onto the intermediate transfer belt 15 to paper P (an example of a recording medium), and a fixing device 34 that fixes the image secondarily transferred onto the paper P.

Additionally, the image forming apparatus of this example includes a controller 40 that controls the operation of the respective sections, and a user interface (UI) 41 for presenting information to a user or receiving an instruction from the user.

The image forming units 1Y, 1M, 1C, and 1K have photoconductor drums 11Y, 11M, 11C, and 11K that rotate in the direction of an arrow in the drawing, respectively. Additionally, various kinds of electrophotographic devices, including a charger 12 that charges the photoconductor drum 11, an exposure unit 13 that irradiates the photoconductor drum 11 with an exposure beam Bm to write an electrostatic latent image on the drum, a developer unit 14 that contains each color component toner, and makes the electrostatic latent image on each of the photoconductor drums 11Y, 11M, 11C, and 11K into a visual image with the toner to form a toner image, a primary transfer roll 16 that transfers the toner image of each color component formed on each of the photoconductor drums 11Y, 11M, 11C, and 11K onto the intermediate transfer belt 15 in a superposed manner in the primary transfer section 10, and a drum cleaner 17Y, 17M, 17C, or 17K that removes the residual toner on each of the photoconductor drums 11Y, 11M, 11C, and 11K, are sequentially disposed around each of the photoconductor drums 11Y, 11M, 11C, and 11K.

The image forming units 1Y, 1M, 1C, and 1K are arranged in the shape of a substantially straight line in order of yellow (Y), magenta (M), cyan (C), and black (K) from the upstream side of the intermediate transfer belt 15, and is configured so as to able to come into contact with or separate from the intermediate transfer belt 15.

Additionally, the illustrated electrophotographic apparatus, includes, as a paper transporting system, a paper feed mechanism section 31 that performs the paper feed operation of taking out paper P from a paper accommodating section and feeding the paper into the secondary transfer section 20, a transporting belt 32 that transports the paper P, which has passed through the secondary transfer section 20, to the fixing device 34 side, a fixing inlet guide 33 that guides the paper P to an inlet of the fixing device 34, a paper discharge guide 35 that guides the paper P discharged from the fixing device 34, and a paper discharge roll 36 that discharges the paper P guided by the paper discharge guide 35 to the outside of the apparatus.

That is, the paper P fed from the paper accommodating section to the secondary transfer section 20 by the paper feed mechanism section 31 is transported to the transporting belt 32 in a state where the paper is peeled from the intermediate transfer belt 15 after the toner images on the intermediate transfer belt 15 are electrostatically transferred in the secondary transfer section 20. Then, the paper is transported to the fixing device 34 via the fixing inlet guide 33 in conformity with the operating speed of the fixing device 34 by the transporting belt 32. An unfixed toner image on the paper P transported to the fixing device 34 is fixed on the paper P by receiving the fixing processing of applying heat and pressure using the fixing device 34. Thereafter, the paper P on which the fixed image has been formed is transported to a discharged paper accommodating section (not shown) provided outside the apparatus, via the paper discharge guide 35 and the paper discharge roll 36.

Additionally, a belt cleaner 17A that removes the residual toner on an intermediate transfer belt 15 is disposed downstream of the secondary transfer section 20.

Here, the photoconductor drums 11Y, 11M, 11C, and 11K and the intermediate transfer belt 15 that are illustrated above are equivalent to toner image carriers that carry toner images in the invention. In the following descriptions, for convenience, these toner image carriers are generically described as a toner image carrier 11.

Additionally, the drum cleaners 17Y, 17M, 17C, and 17K and belt cleaner 17A that are illustrated above are equivalent to cleaning devices that remove the residual toner remaining on the surface of the toner image carrier 11 in the invention. In the following descriptions, for convenience, these cleaning devices are generically described as a cleaning device 17.

In addition, the residual toner that the cleaning device 17 has removed from the toner image carrier 11 is recovered by a toner recovery unit (not shown) provided in the electrophotographic apparatus.

Figure 1:
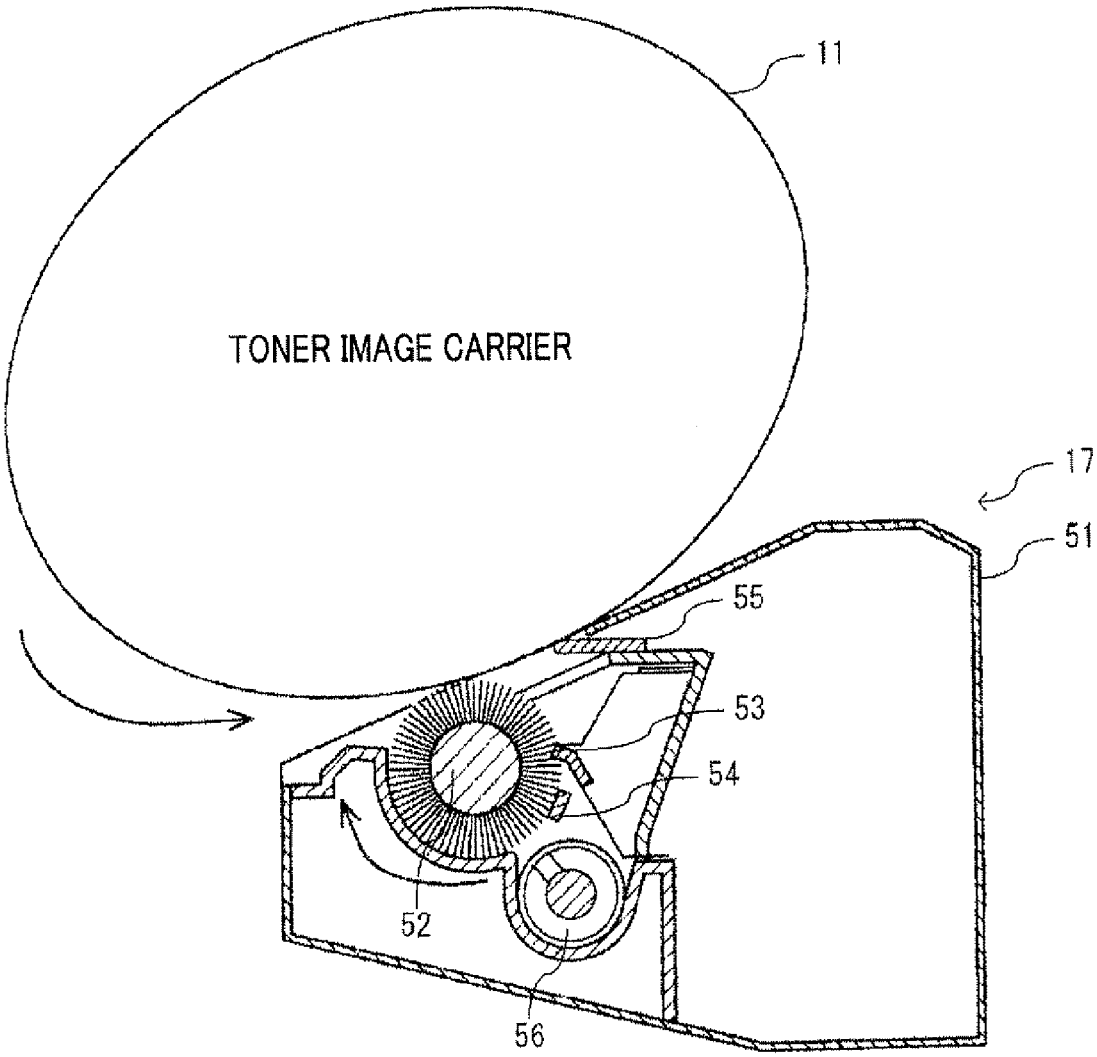
FIG. 1 is a cross-sectional view of a cleaning device related to one exemplary embodiment of the invention.
Figure 2:
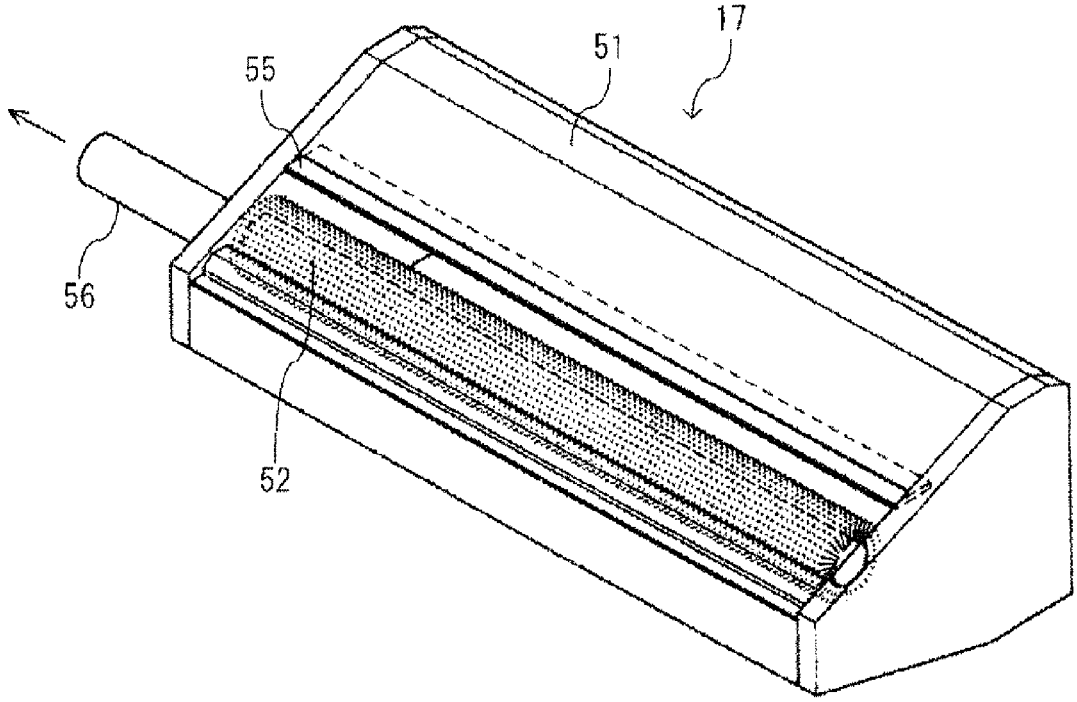
FIG. 2 is a perspective view of the cleaning device related to one exemplary embodiment of the invention.

The details of the cleaning device 17 related to one exemplary embodiment of the invention are shown in FIGS. 1 and 2, and the cleaning device 17 is the drum cleaners 17Y, 17M, 17C, and 17K and the belt cleaner 17A that correspond to any of the photoconductor drums 11Y, 11M, 11C, and 11K and the intermediate transfer belt 15, which are in the toner image carrier 11.

A housing 51 of the cleaning device 17 is in the shape of a box formed with an opening that faces the toner image carrier 11, a brush roll 52 that rotates around its shaft is provided within the housing 51, and the brush roll 52 contacts the toner image carrier 11 through the opening of the housing 51.

Accordingly, the brush roll 52 rotates with the toner image carrier 11, and the residual toner remaining on the surface of the toner image carrier 11 adheres to brush bristles of the peripheral surface of the brush roll 52, and is removed.

An edge plate 53 is provided as a toner removal part in contact with the surface of the brush roll 52 within the housing 51 of the cleaning device 17, and the edge plate 53 is located closer to the downstream side in the rotational direction of the brush roll 52 than a position where the brush roll 52 contacts the toner image carrier 11, and extends over the total length of the brush roll 52.

Accordingly, the residual toner adhering to the brush bristles of the peripheral surface of the brush roll 52 is shaken by the edge plate 53, and is recovered in the housing 51.

In addition, the toner removal part is not limited to an example having such a plate shape, and various toner removal parts may be used if the residual toner adhering to the brush bristles of the peripheral surface of the brush roll 52 may be shaken off.

A pressure sensor 54 that is a pressure detector is provided downstream of the edge plate 53 in the rotational direction of the brush roll 52, and at least a pressure-sensitive surface of the pressure sensor 54 contacts the surface of the brush roll 52 with preload.

This preload, as will be described below, is provided to prevent residual toner from being accumulated on the pressure-sensitive surface of the pressure sensor 54, to prevent erroneous detection caused by the pressure sensor 54. The pressure of the preload is set so that the residual toner does not enter the pressure-sensitive surface side of the pressure sensor 54.

As the pressure sensor 54, various pressure sensors, such as a strain gage resistance type, a semiconductor piezoresistance type, an electrostatic capacitance type, a silicon resonant type, an electromagnetic induction type, and a conductor dispersion film electric resistance change type, may be adopted if a force applied to a given area may be converted into an electrical signal. In addition, the conductor dispersion film electric resistance change type may be preferable, because an electric circuit related to control can be simply made.

The number or size of the pressure sensor 54 is not particularly limited, and pressure may be able to be detected from at least one surface portion of the brush roll 52. A pressure sensor that may detect pressure over a wide range or total length of the brush roll 52 may be preferable. For example, providing plural pressure sensors in plural locations in the axial direction of the brush roll 52, providing one pressure sensor having a wide pressure-sensitive surface in the axial direction of the brush roll 52, and the like may be adopted. In addition, providing one pressure sensor may simplify control electronic circuits.

Additionally, in the cleaning device 17 of this example, the housing 51 is provided with the cleaning blade 55 that extends in the width direction of the toner image carrier 11, and the tip end of the cleaning blade 55 faces the opening of the housing 51 and contacts the surface of the toner image carrier 11.

Accordingly, the residual toner remaining on the surface of the toner image carrier 11 is also removed by the cleaning blade 55.

Although providing the cleaning blade 55 may be preferable to enhance the removal performance of the residual toner from the toner image carrier 11, it is not indispensable in the aspect of the invention.

A toner recovery unit 56 is provided at the bottom within the housing 51, and the toner recovery unit 56 sends the residual toner accumulating in the housing 51 to a recovery bottle (not shown) through the rotation of an auger screw.

Figure 3:
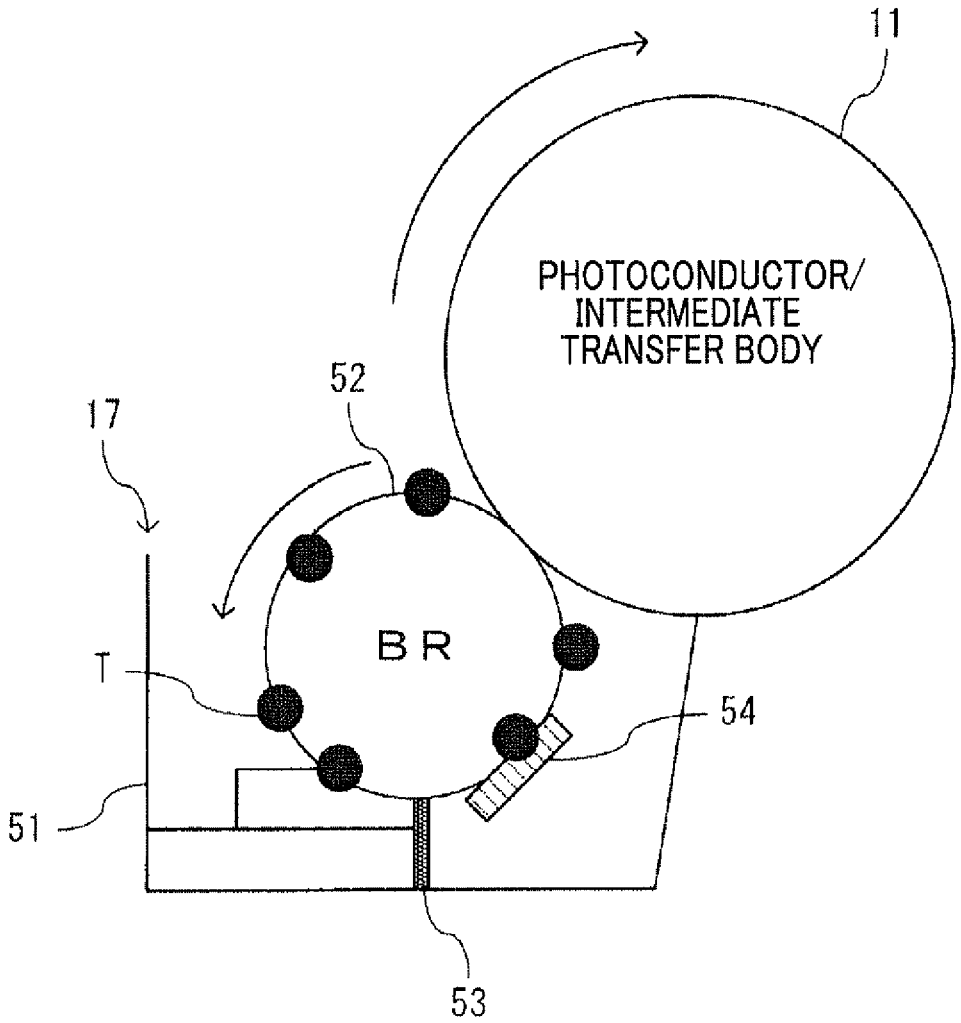
FIG. 3 is a conceptual diagram illustrating the operation of the cleaning device related to one exemplary embodiment of the invention.

FIG. 3 conceptually shows an operation through which the pressure sensor 54 detects the pressure of the brush roll 52. In this aspect of the invention, the cleaning blade 55 is omitted.

If residual toner T of the toner image carrier 11 adheres to the peripheral surface of the brush roll 52 and is carried through the rotation of the brush roll 52, the residual toner is shaken by the edge plate 53 and removed from the brush roll 52.

Then, a peripheral surface portion of the brush roll 52 from which the residual toner T is shaken by the edge plate 53 contacts the pressure-sensitive surface of the pressure sensor 54.

Accordingly, the value of the pressure received from the peripheral surface of the brush roll 52 from which the residual toner T has been shaken off is detected.

Here, since the pressure sensor 54 contacts the peripheral surface of the brush roll 52 with preload, the pressure sensor 54 pushes away the residual toner T that remains without being shaken off from the peripheral surface of the brush roll 52, to prevent the residual toner T from entering the pressure-sensitive surface of the pressure sensor 54. This prevents the residual toner T from being accumulated and entering between the surface of the brush roll 52 and the pressure-sensitive surface of the pressure sensor 54, to affect a pressure value detected by the pressure sensor 54.

Figure 4:
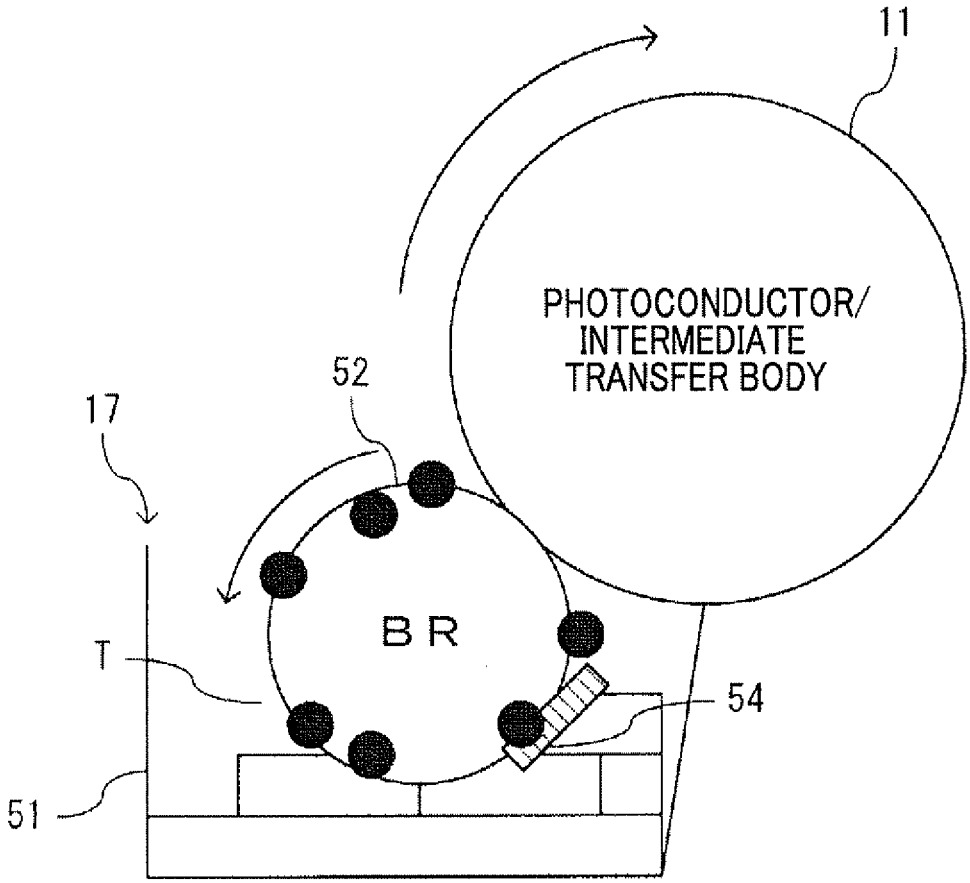
FIG. 4 is a conceptual diagram illustrating the operation of a cleaning device related to another exemplary embodiment of the invention.

FIG. 4 conceptually shows an operation through which the pressure sensor 54 detects the pressure of the brush roll 52 in a modification of the cleaning device 17.

In this example, since the edge plate 53 is omitted, and an end portion of a device that constitutes the pressure sensor 54 is provided in a state where the end portion has entered the bristle tips of the brush roll 52, residual toner T that has adhered to the brush roll 52 is shaken off by the edge of the pressure sensor device 54 in the rotational direction of the brush roll 52.

Accordingly, even if the edge plate 53 is omitted, the peripheral surface portion of the brush roll 52 from which the residual toner T has been shaken off contacts the pressure-sensitive surface of the pressure sensor 54, and along with the above action using preload, the residual toner T is prevented from entering between the surface of the brush roll 52 and the pressure-sensitive surface of the pressure sensor 54.

Figure 5:
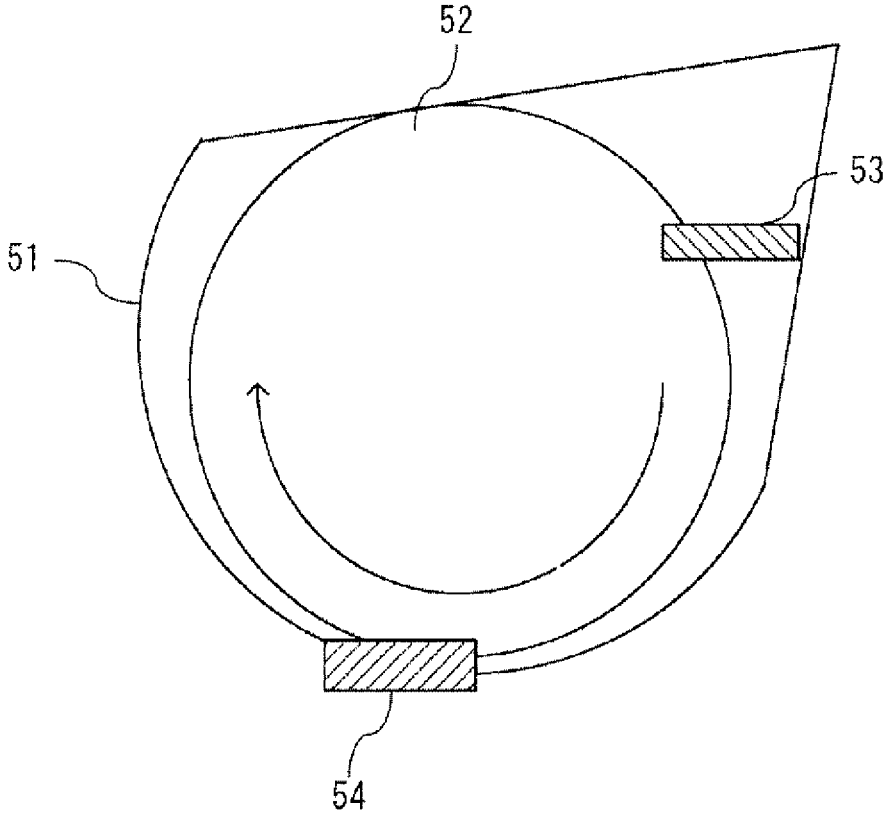
FIG. 5 is a conceptual diagram illustrating the relationship between a pressure sensor and a brush roll related to an example of the invention.

In addition, as shown in FIG. 5, the edge plate 53 may be provided, and an end portion of the pressure sensor device 54 may be provided in a state where the end portion has entered the bristle tips of the brush roll 52.

FIGS. 6A to 6D show examples of the preferable shape of the edge of the pressure sensor device 54 in which the end portion is provided in a state where the end portion has entered the bristle tips of the brush roll 52.

Figure 6A:
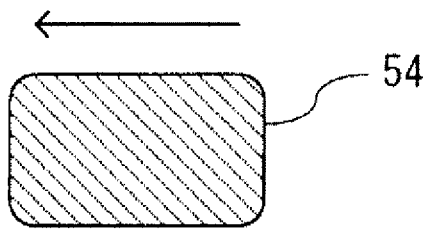
FIGS. 6A to 6D are views illustrating the shape of an end portion of a pressure sensor device related to the example of the invention.
Figure 6B:
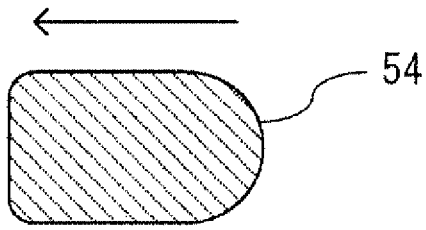
Figure 6C:
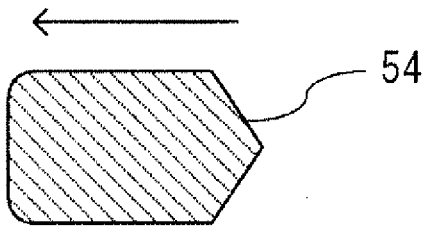
Figure 6D:
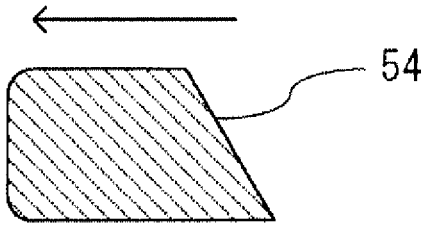

A pressure sensor device 54 shown in FIG. 6A has a shape in which the corners of the end portion that enters the bristle tips of the brush roll 52 are rounded, and a pressure sensor device 54 shown in FIG. 6B has a shape in which the corners of the end portion that enters the bristle tips of the brush roll 52 are rounded, and the end face is curved. A pressure sensor device 54 shown in FIG. 6C has a shape in which the end face of the end portion that enters the bristle tips of the brush roll 52 is chevron-shaped, and a pressure sensor device 54 shown in FIG. 6D has a shape in which the end face of the end portion that enters the bristle tips of the brush roll 52 is formed as included surface at an obtuse angle.

These shapes may prevent the bristle tips of the brush roll 52 from being damaged due to application of an excessive resistance. In addition, the invention is not limited to the above examples, and various shapes may be adopted.

Additionally, in a case where the pressure sensor device 54 is provided at an axial end portion of a brush roll 52, it is preferable to provide a gap of, for example, 50 μm or more between the pressure sensor device 54 and the housing 51 so that the residual toner removed by the end portion of the pressure sensor device 54 may move.

Figure 7:
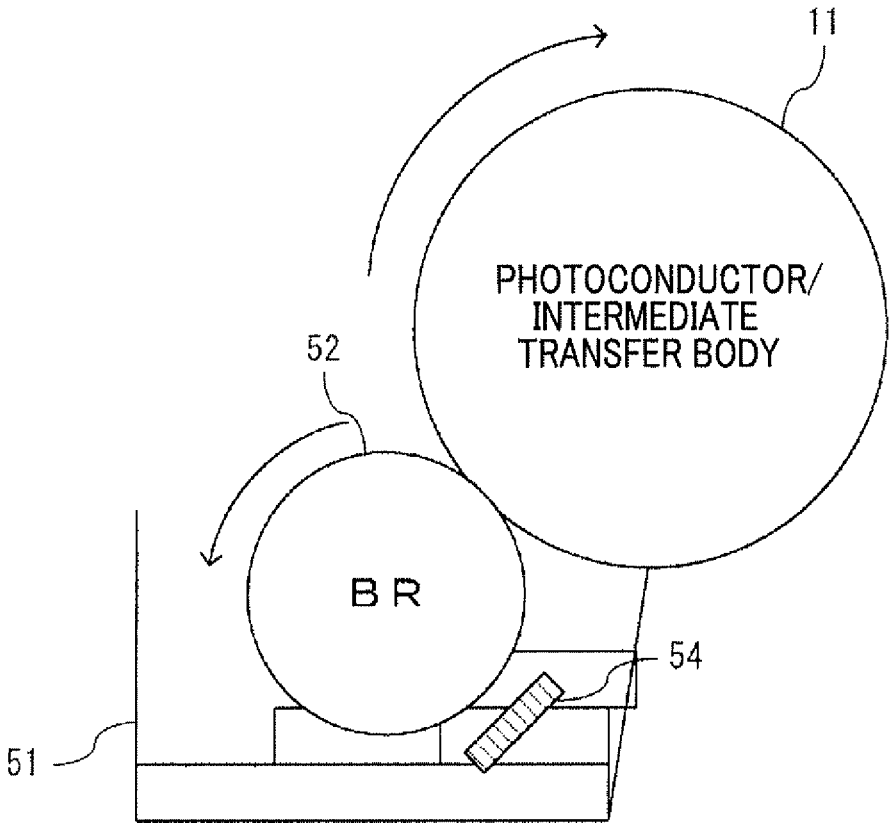
FIG. 7 is a conceptual diagram illustrating a comparative example.

Next, comparison experiment results of the configuration (Condition 1) related to one example of the invention shown in FIG. 4 and a configuration (Condition 2) with a gap between the pressure sensor 54 and the brush roll 52 as shown in FIG. 7 will be described.

In the comparison experiments, experiments are performed on Condition 1 and Condition 2 regarding a belt cleaner (cleaning device) of a belt transfer system, using a printer apparatus (Color 1000 made by FUJI Xerox Corp.) as the electrophotographic apparatus.

Additionally, a film-like pressure sensor made by Nitta, Inc. (A201-1) is used as the pressure detector 54, and an exclusive amplifier box of the sensor is adjusted so as to output 1 V when a load of 1 g is applied to a whole sensing area with a diameter of 9.5 mm. Then, this amplifier output is read by a control PC via an A/D converter.

In Condition 1 (FIG. 4), a cleaning device that is a new article and to which toner does not adhere at all is prepared, and the film sensor 54 is pasted on the inside of the housing 51, and the force with which the brush roll 52 pushes the pressure-sensitive surface of the film sensor 54 is set to 0.5 g.

In Condition 2 (FIG. 7), a cleaning device that is a new article and to which toner does not adhere at all is prepared, and the film sensor 54 is pasted on the inside of the housing 51, and the force with which the brush roll 52 pushes the pressure-sensitive surface of the film sensor 54 is set to 0 g so that there is a gap between the film sensor 54 and the brush roll 52.

In each of Conditions 1 and 2, printing is performed on 200,000 sheets of A3 paper such that a printable region becomes a black solid over the entire surface.

The results based on Condition 1 are as follows. Minute black spots observable by a magnifying glass begin to be generated on a printed image from about the 50,000th sheet, and black spots that grow in the shape of a comet at about the 100,000th sheet begin to appear, and a black streaky image defect is seen on the whole surface at about the 150,000th sheet.

Figure 8A:
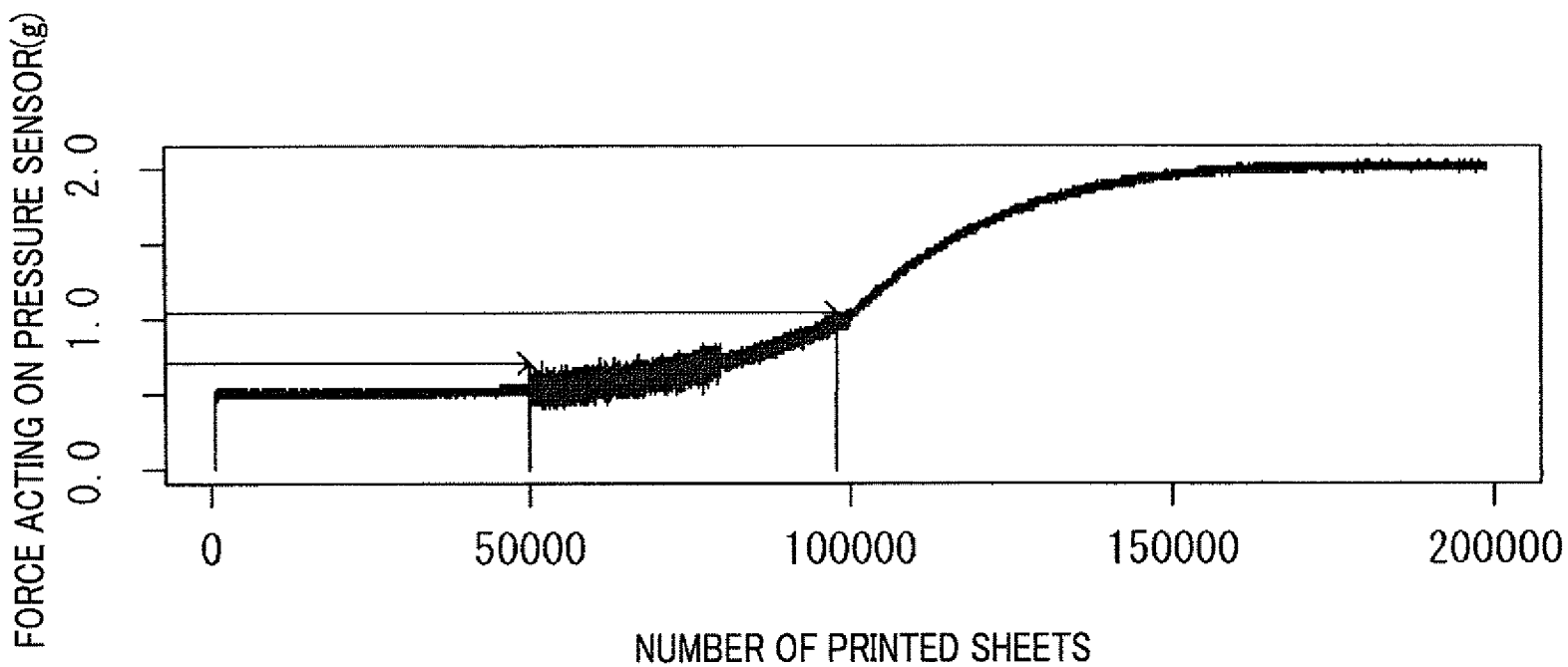
FIGS. 8A and 8B are views showing pressure changes of one exemplary embodiment of the invention and a comparative example.

Changes in the force with which the brush roll 52 pushes the pressure-sensitive surface of the film sensor 54 on this Condition 1 are as shown in FIG. 8A. That is, although the initial value of the force is 0.5 g that is the same until about the 50,000th sheet in which abnormalities are not observed, the force continues rising gently after this, and becomes about 0.6 g, becomes 1 g at about the 100,000th sheet, and becomes 2 g at about the 150,000th sheet.

That is, it is recognized that there is a relationship according to the number of printed sheets (the amount of operation) between the state of defects appeared on a printed image and the force (that is, a pressure value detected) applied to the film sensor 54. For example, if an alarm is issued before the 100,000th sheet that is brought into a state where an image defect is clear as viewed with eyes, occurrence of such an image defect may be prevented in advance.

One of the factors that cause such an image defect is that the residual toner adhering to the brush bristles of the brush roll 53 may anchor, the brush bristles may lose flexibility, and the residual toner to be removed by the brush roll 52 may be transferred to a printed image.

Since the force (pressure) of pushing the pressure-sensitive surface of the film sensor 54 rises if the flexibility of the brush bristles is impaired in this way, the adhesion state of the residual toner to the brush roll 52, and thus the occurrence situation of an image defect may be known depending on changes in the pressure value that the film sensor 54 detects.

Figure 8B:
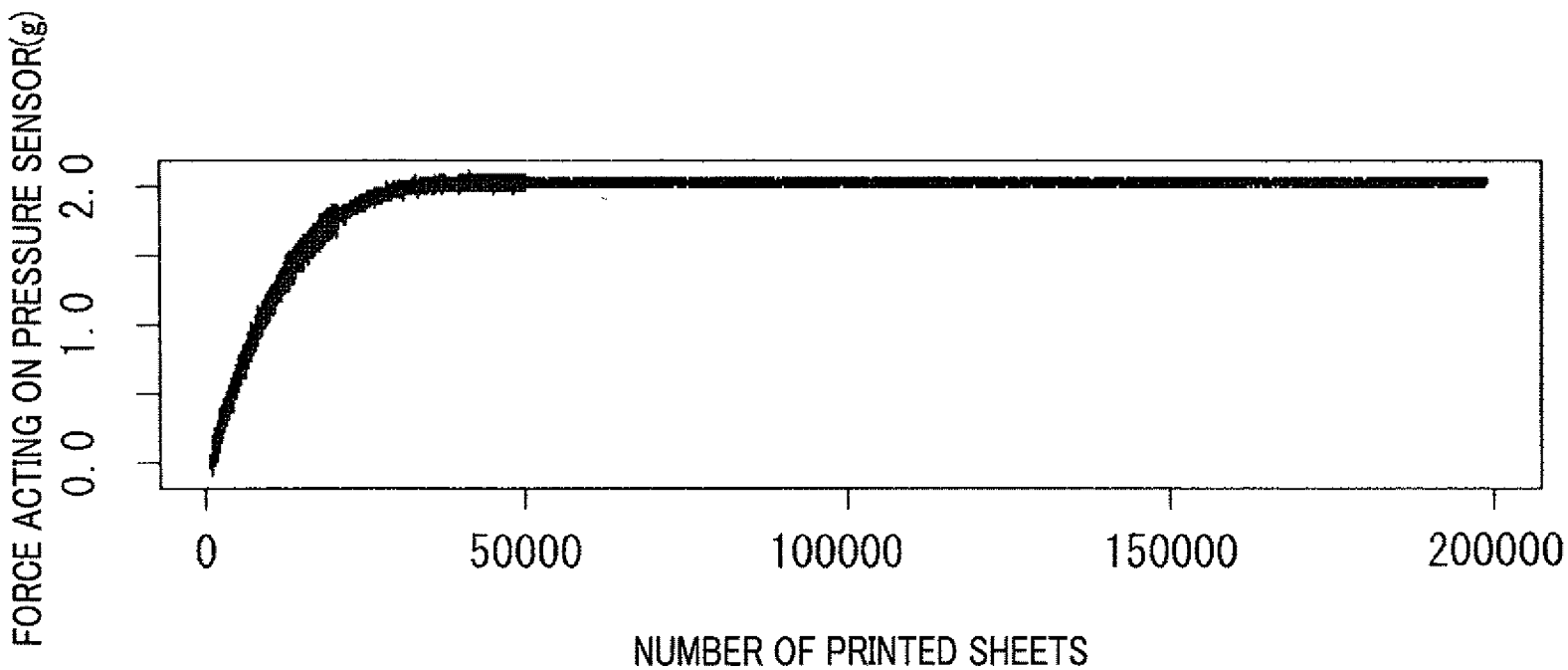

On the other hand, in Condition 2, changes in the force that the pressure-sensitive surface of the film sensor 54 receives is shown in FIG. 8B. That is, the force with which the pressure-sensitive surface of the film sensor 54 is pushed rises rapidly immediately after the start of operation, and exceeds a measuring range before about the 50,000th sheet from which an abnormality begins to occur.

This may be said that residual toner may enter and accumulate between the pressure-sensitive surface of the film sensor 54 and the peripheral surface of the brush roll 52, and thereby, the detection pressure value of the film sensor 54 may have risen at one time.

Accordingly, in Condition 2, changes in the pressure value according to the adhesion state of the residual toner to the brush roll 52 may not be detected like in Condition 1. Thus, the above alarm may not be issued.

Figure 9:
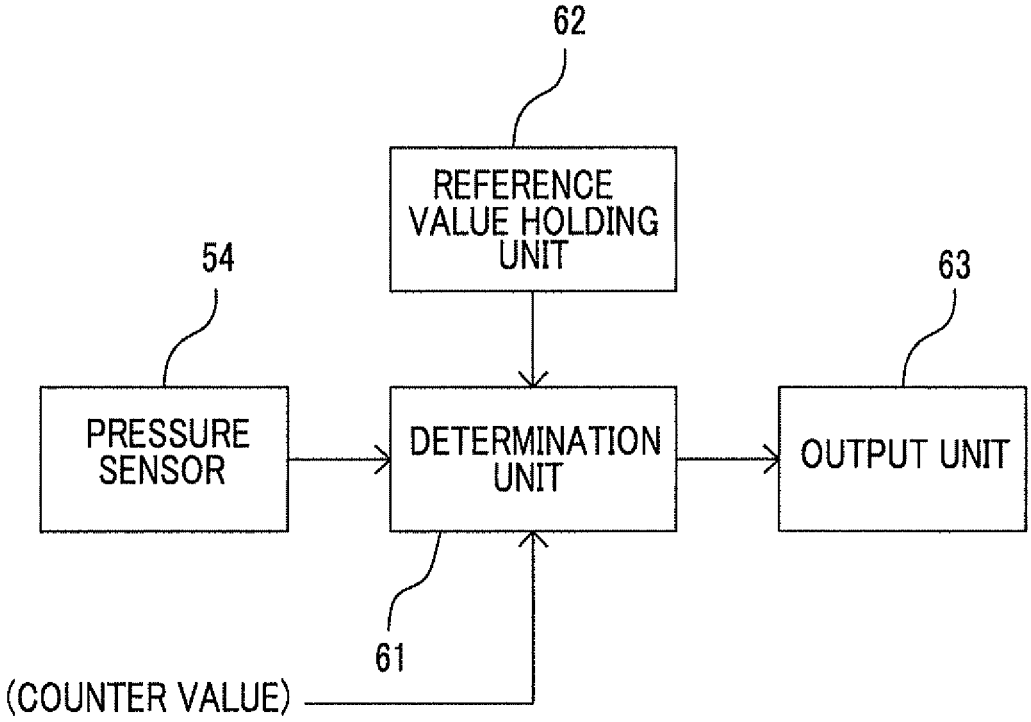
FIG. 9 is a configuration diagram of a determination function related to one exemplary embodiment of the invention.

FIG. 9 shows a configuration for issuing an alarm using the pressure value detected by the pressure sensor 54 as mentioned above.

That is, the above configuration includes a determination unit 61 to which the pressure value detected by the pressure sensor 54 is input, a reference value holding unit 62 that holds a preset reference value as the pressure value to issue an alarm, and an output unit 63 that outputs an alarm.

The determination unit 61 and the reference value holding unit 62 may be constructed in the controller 40 provided in the electrophotographic apparatus, and the output unit 63 is constructed in a UI 41 provided in the electrophotographic apparatus.

Accordingly, if the pressure value detected by the pressure sensor 54 is input to the determination unit 61 with the operation of the electrophotographic apparatus, the determination unit 61 determines whether or not the input pressure value has reached the reference value held by the holding unit 62. When the reference value is reached, an alarm is output from the output unit 63 to notify that maintenance is necessary, such as replacement of the brush roll or cleaning of the cleaning device, or occurrence of an image defect to a user.

Here, the setting value of the reference value may be arbitrarily set if necessary. To make a description using the example shown in FIG. 8A, for example, if the reference value is set to 0.6 g, an alarm indicating that an image defect will occur when about 50,000 sheets are printed afterwards may be issued in advance, and if the reference value is set to 1 g, an alarm indicating that an image defect will occur soon may be issued.

In the above example, an alarm is notified to a user. However, for example, an alarm may be output to a remote management device with the output unit as a network interface so as to notify an administrator of the electrophotographic apparatus.

Additionally, although the electrophotographic apparatus that performs development with four colors of toner, such as yellow (Y), magenta (M), cyan (C), and black (K), has been described as an example, the invention is not particularly limited by the kinds or number of toners, the types of electrophotographic apparatuses, or the like if electrophotographic apparatus image forming apparatuses that perform toner development, are provided, such as an image forming apparatus that performs development with five colors of toners in which a transparent toner is added to the above colors, and an image forming apparatus that performs development with one color of toner of black (K).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a brush roll that removes residual toner remaining on a surface of a toner image carrier provided in an electrophotographic apparatus; and a pressure detector that has a pressure-sensitive surface, the pressure-sensitive surface directly contacting a surface of the brush roll with preload, and outputs a detected pressure value to a determination unit that is provided in the electrophotographic apparatus to determine an adhesion state of toner to the brush roll;

wherein the pressure detector is a pressure sensor device, and the pressure sensor device is provided in a state where an end portion thereof has entered bristle tips of the brush roll during a normal state of operation.

2. The cleaning device according to claim 1, further comprising:

a toner removal part that contacts the surface of the brush roll, wherein the pressure detector contacts the surface of the brush roll with preload downstream of the toner removal part in a rotational direction of the brush roll.

3. An electrophotographic apparatus comprising:

a toner image carrier;

a brush roll that removes residual toner remaining on a surface of the toner image carrier;

a pressure detector that has a pressure-sensitive surface, the pressure-sensitive surface directly contacting a surface of the brush roll with preload; and a determination unit that determines an adhesion state of toner to the brush roll, on the basis of a pressure value detected by the pressure detector, wherein the pressure detector is a pressure sensor device, and the pressure sensor device is provided in a state where an end portion thereof has entered bristle tips of the brush roll during a normal state of operation.

4. The electrophotographic apparatus according to claim 3, further comprising:

an output unit that outputs an alarm, wherein the determination unit outputs an alarm from the output unit, according to a pressure value detected by the pressure detector having reached a preset reference value.

* * * * *